United States Patent [19]
Takase et al.
[11] 4,186,691
[45] Feb. 5, 1980

[54] DELAYED RESPONSE DISABLING CIRCUIT FOR CLOSED LOOP CONTROLLED INTERNAL COMBUSTION ENGINES

[75] Inventors: Sadao Takase, Yokohama; Masaharu Asano, Yokosuka, both of Japan

[73] Assignee: Nissan Motor Company, Limited, Yokohama, Japan

[21] Appl. No.: 831,061

[22] Filed: Sep. 6, 1977

[30] Foreign Application Priority Data

Sep. 6, 1976 [JP] Japan ..... 51/105847

[51] Int. Cl.[2] ..... F02B 3/08; F02M 7/12; F01N 3/08

[52] U.S. Cl. ..... 123/32 EL; 123/32 EE; 123/32 EH; 123/119 EC; 60/276; 60/285

[58] Field of Search ..... 123/32 EE, 32 EL, 32 EH, 123/32 EK, 32 EA, 119 EC, 198 DB; 60/285, 276

[56] References Cited

U.S. PATENT DOCUMENTS

| | | | |
|---|---|---|---|
| 3,903,853 | 9/1975 | Kizler et al. | 123/32 EE |
| 3,916,170 | 10/1975 | Norimatsu et al. | 123/32 EE |
| 3,919,983 | 11/1975 | Wahl et al. | 123/32 EA |
| 3,938,075 | 2/1976 | Reddy | 60/285 |
| 3,938,479 | 2/1976 | Oberstadt | 123/32 EE |
| 3,939,654 | 2/1976 | Creps | 60/285 |
| 3,990,411 | 11/1976 | Oberstadt et al. | 60/276 |
| 4,040,408 | 8/1977 | Kraus et al. | 60/276 |
| 4,064,846 | 12/1977 | Latsch et al. | 123/32 EA |
| 4,094,274 | 6/1978 | Harada et al. | 123/32 EL |
| 4,123,999 | 11/1978 | Asano | 123/32 EE |

FOREIGN PATENT DOCUMENTS

| | | | |
|---|---|---|---|
| 2647693 | 5/1977 | Fed. Rep. of Germany | 123/119 EC |

*Primary Examiner*—Charles J. Myhre
*Assistant Examiner*—P. S. Lall
*Attorney, Agent, or Firm*—Lowe, King, Price & Becker

[57] ABSTRACT

A disabling circuit for a closed loop fuel controlled internal combustion engines of the type wherein fuel is completely cut off during deceleration includes a circuit for generating an electrical signal of a duration corresponding to the duration of fueld cut-off. A timing circuit respectively insensitive and sensitive to electrical signals of short and long durations derives a disabling signal which clamps the feedback signal to a suitable control voltage until the end of the electrical signal. The timing circuit is responsive to the end of the electrical signal to introduce a delay time to prolong the disabling signal and prevent the lean mixture fuel cut-off periods from adversely affecting control system when it resumes closed loop operation.

13 Claims, 6 Drawing Figures

DELAYED RESPONSE DISABLING CIRCUIT FOR CLOSED LOOP CONTROLLED INTERNAL COMBUSTION ENGINES

FIELD OF THE INVENTION

The present invention relates generally to closed loop fuel control systems for internal combustion engines and in particular to a fuel control system for an internal combustion engine of the type provided with a means for cutting off fuel supply during deceleration in which the fuel control system is disabled in delayed response to the fuel cut-off operation.

CROSS-REFERENCE TO PRIOR ART

U.S. patent application Ser. No. 734,115, filed Oct. 20, 1976, U.S. Pat. No. 4,123,999.

BACKGROUND OF THE INVENTION

In a closed loop fuel control system, the air-fuel ratio of the post combustion gases is sensed by an exhaust gas sensor to derive a feedback control signal which is used to control the ratio of air to fuel prior to combustion so that the air-fuel ratio of the exhaust gases is controlled within a narrow range of air-fuel ratios where the efficiency of three-way catalytic conversion is at a maximum.

In internal combustion engines of the type which completely cut off fuel supply during deceleration, the closed loop fuel control sense a lean condition which results in an enrichment signal during the fuel cut-off period. In response to the enrichment signal, the system supplies an excessively rich mixture at the instant when the fuel supply is restarted so that the air-fuel ratio within the exhaust system drifts from the desired range. It is therefore desirable to disable the closed loop fuel control during such fuel cut-off periods. However, a momentary throttling operation during transmission gear changes may be erroneously sensed as a deceleration to cut off the fuel. If the closed loop control is disabled during such operation, the system will oscillate abnormally.

SUMMARY OF THE INVENTION

An object of the present invention is to provide a fuel control system for an internal combustion engine of the type provided with means to completely cut off the fuel supply during deceleration, wherein the control system is disabled so it is insensitive to a brief fuel cut-off operation and sensitive to a fuel cut-off operations which persist for a longer interval.

Another object of the invention is to provide a fuel control system wherein the closed loop control is disabled for an extended period of time from the end of fuel cut-off operation to prevent the lean mixture during the fuel cut-off period from adversely affecting the closed loop control when it resumes after the fuel supply is restarted.

BRIEF DESCRIPTION OF THE DRAWINGS

The invention will be further described with reference to the accompanying drawings, in which.

DESCRIPTION OF THE PREFERRED EMBODIMENTS

Figure 1:
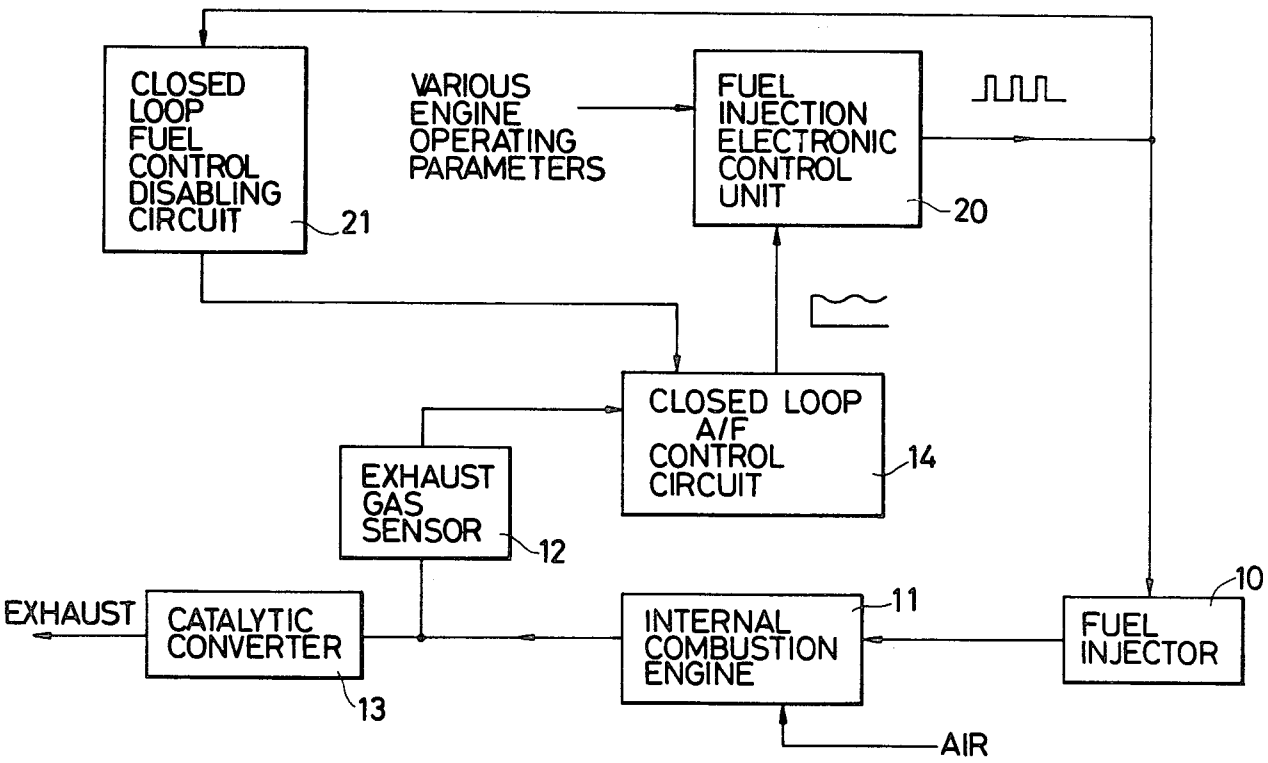
FIG. 1 is a schematic illustration of an embodiment of the invention.

Referring now to FIG. 1, a closed loop mixture control system embodying the invention is illustrated. The internal combustion engine 11 is supplied with air through an intake pipe (not shown) and fuel from injector 10 in a controlled air-fuel ratio. In the exhaust pipe is provided an exhaust gas sensor 12 upstream from a three-way catalytic converter 13. Catalytic converter 13 is a device of the type in which exhaust gases flowing therethrough are exposed to a catalytic substance which, given the proper air-fuel ratio in the exhaust gases, promotes simultaneous oxidation of carbon monoxide and hydrocarbons and reduction of oxides of nitrogen. The exhaust gas sensor 12 is an oxygen sensor of the zirconia electrolyte type which, when exposed to engine exhaust gases at high temperatures, generates an output voltage which changes appreciably as the air-fuel ratio of the exhaust gases passes through the stoichiometric level. The output voltage of the sensor 12 is a function of air-fuel ratio determined by the fuel injector 10 and exhibits a fairly steep slope as the mixture passes through stoichiometry.

The output from the oxygen sensor 12 is fed into a closed loop mixture control unit 14 to generate a signal which is used to correct the air-fuel ratio to a desired value where the efficiency of three-way catalytic conversion is at a maximum.

Figure 2:
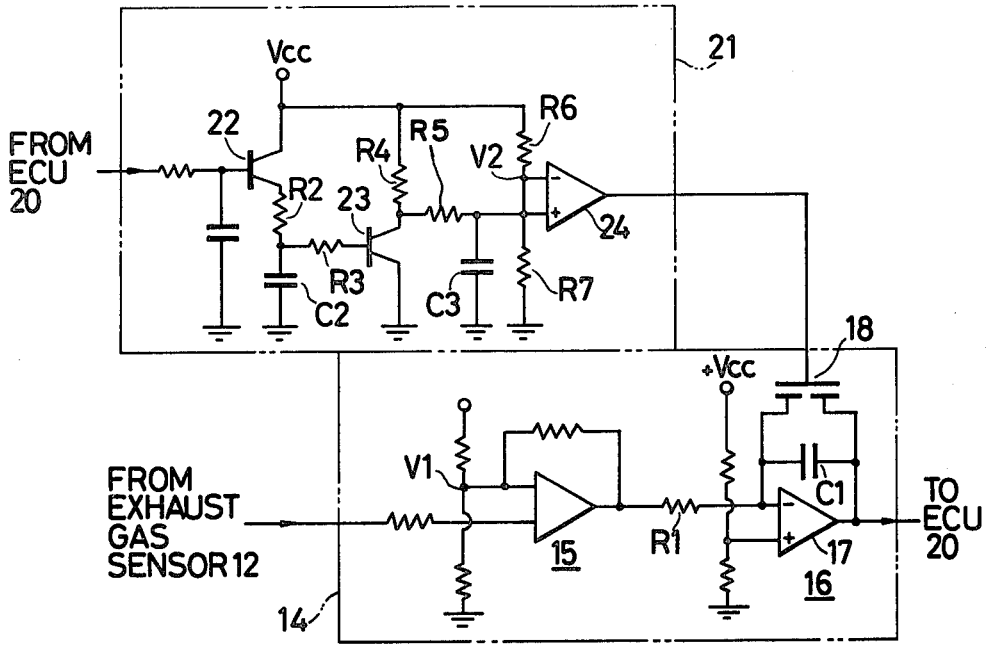
FIG. 2 is a circuit diagram of a part of the embodiment of FIG. 1.

As shown in detail in FIG. 2, the control unit 14 includes a differential amplifier 15 which computes the difference between the sensor output and a reference $V_1$, which difference is supplied to an integral controller 16 comprised of an operational amplifier 17 having a noninverting input connected to a given DC potential and an inverting input connected to its output by means of an integrating capacitor C1 and to the output of the differential amplifier 15 by a resistor R1. The capacitor C1 is connected in parallel with a trasistor switch 18 which provides a low resistance discharge path across the capacitor C1 in response to a signal applied to the transistor control gate.

A fuel injection electronic control unit 20 of the conventional design (FIG. 1) receives various engine operating parameters, including throttle position, to determine the duration of injection pulses supplied to injector 10 so that the opening time of the injector is controlled. Consequently the quantity of fuel supplied to engine 11 is varied in response to the various engine operating parameters unit 20 is designed to cut off fuel in response to particular engine operating parameters, such as nearly closed throttle position and engine R.P.M indicating deceleration of the engine. The output from the integral controller 16 is applied to the electronic control unit 20 to modify or correct the width of the injection pulse in accordance with the sensed air-fuel ratio.

A closed loop control disabling circuit 21 is provided which receives its input signal from the electronic control unit 20. The disabling circuit 21 includes as shown in FIG. 2, a transistor 22 having a base connected to the output of the control unit 20. The emitter of transistor 22 is connected to ground by a series circuit including resistor R2 and capacitor C2 which is charged by current supplied from voltage source Vcc through the collector-emitter path of transistor 22. The base electrode of transistor 23 is connected to the junction of resistor R2 and capacitor C2 by resistor R3. The emitter and collector of transistor 23 are respectively connected to ground and by resistor R4 to the voltage source Vcc. Resistor R3 is selected to have a value larger than that of resistor R2 so that capacitor C2 is charged at a higher rate than it is discharged. The collector of transistor 23 is connected to ground by a series circuit including a resistor R5 and a capacitor C3. The noninverting input of a comparator 24 is connected to the junction between the resistor R5 and capacitor C3, the inverting input of the comparator being connected to a reference voltage $V_2$ supplied from the junction of a series-connected resistors R6 and R7. The output of the comparator 24 is connected to the control gate of the transistor switch 18 of the closed loop fuel control circuit 14.

Figure 3:
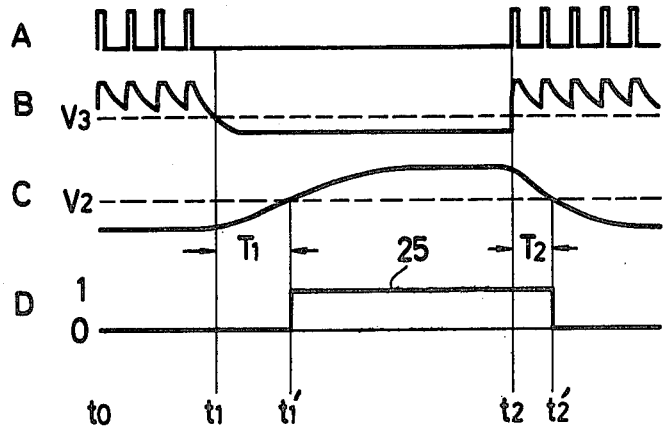
FIG. 3 is a waveform diagram useful for describing the operation of the circuit of FIG. 2.

The operation of the circuit of FIG. 2 will be comprehended by reference to the waveform shown in FIG. 3. It is assumed that fuel cut-off operation is effected during time interval $t_1$ to $t_2$ so that injection pulses are applied to the base electrode of transistor 22 of the disabling circuit 21 during time interval $t_o$ to $t_1$ and after time $t_2$ as shown in FIG. 3A. In response to the injection pulses, the transistor 22 is switched on and off and charges the capacitor C2 through resistor R2 so that the voltage across capacitor C2 rapidly rises in response to the conduction of transistor 22 and discharges gradually in response to the nonconduction of transistor 22 through resistor R3 as illustrated in FIG. 3B. When the injection pulses occur successively, the capacitor C2 will be charged again before the voltage across it drops below the threshold level of the transistor 23 so that transistor 23 is in the conductive state which provides a shunt across the circuit including resistor R5 and capacitor C3. When the fuel cut-off operation occurs and consequently no injection pulses are applied to the base of transistor 22, the voltage across capacitor C2 falls below the threshold voltage of transistor 23 as indicated at $V_3$ in FIG. 3B, causing transistor 23 to be switched to the nonconductive state at time $t_1$. With the turn-off of transistor 23, capacitor C3 is charged by current through resistors R4 and R5 so that the voltage across the capacitor C3 gradually increases at a rate determined by the time constant (R4+R5) C3, as illustrated in FIG. 3C. The comparator 24 is switched to the high output state when voltage $V_2$ is reached at time $t_1'$, generating a disabling signal 25 (FIG. 3D) which is coupled to the control gate of the switching transistor 18 so that the integrating capacitor C1 is instantly discharged. Therefore, controller 16 ceases its integration function and the closed loop control is disabled from time $t_1'$.

At time $t_2$, the injection pulse is applied again to the base of transistor 22, causing it to conduct and charge capacitor C2 to turn on transistor 23. The turn-on of transistor 23 causes capacitor C3 to discharge through resistor R5 and through the conducting path of transistor 23 to ground so that the voltage across capacitor C3 drops at a rate determined by the time constant R5C3. The comparator 24 will then be switched to the low output state when the voltage across capacitor C3 falls below voltage $V_2$ at time $t_2'$. Therefore, the disabling of closed loop control takes place at time $t_1'$ after the elapse of a delay interval $T_1$ that begins at time $t_1$. Closed loops control is re-enabled at time $t_2'$ after the elapse of a delay interval $T_2$, that begins at time $t_2$, as shown in FIG. 3D. In delayed response to fuel cut-off, the mixture is leaned resulting in a low voltage from the oxygen sensor 12 and the closed loop control is disabled to prevent it from generating an enrichment signal which would otherwise cause the engine to be excessively enriched when the closed loop control resumes operation. This delayed disabling operation has further advantages. When the driver manipulates the clutch pedal for changing transmission gears while at the same time attempting to accelerate the vehicle, the throttle valve is nearly closed to prevent the engine from running at high speeds due to the disengagement from transmission. The nearly closed position of the throttle commands the fuel injection control unit 20 to effect fuel cut-off operation. Such fuel cut-off operation may last for a period of three to four seconds. If the time interval $T_1$ is selected at a value larger than the interval during which the fuel cut-off of the type above-described occurs, the closed loop fuel control is not disabled to thereby avoid the the introduction of an unnecessary, sudden change of air-fuel ratio. The introduction of delay time $T_2$, on the other hand, allows the lean mixture, inducted immediately prior to time $t_2$, to reach the oxygen sensor 12 during the delayed time interval $T_2$ so that the resumption of closed loop fuel control operation at time $t_2'$ permits the control system to produce a signal which reflects the air-fuel ratio of the mixture inducted at a time subsequent to time $t_2$, rather than that of the mixture inducted prior to time $t_2$. Therefore, the length of time interval $t_2$ should be slightly longer than the transport time of the mixture from the time of induction to the time of sensing of the oxygen component in the exhaust gases by the sensor 12.

Figure 4:
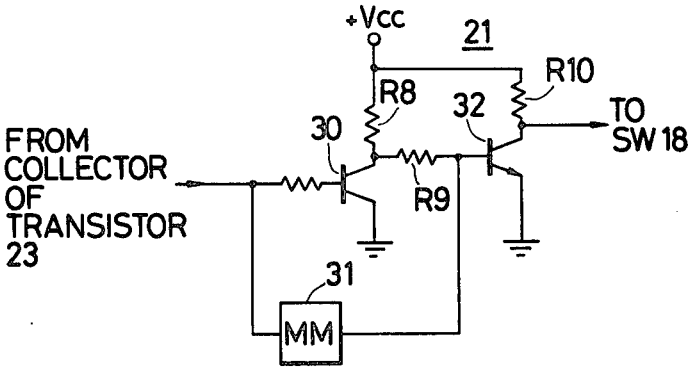
FIG. 4 is a modification of the embodiment of FIG. 1.
Figure 5:
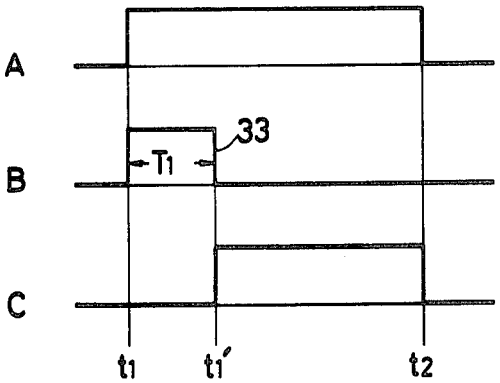
FIG. 5 is a waveform diagram useful for describing the operation of the circuit of FIG. 4.

In FIG. 4 a modification of the disabling circuit of FIG. 2 is shown as including a transistor 30 having its base connected to the collector of transistor 23 of FIG. 2 and a monostable multivibrator 31 having its input connected to the collector of transistor 23 and its output connected to the base of a transistor 32. The collector of transistor 30 is connected by a resistor R9 to the base of transistor 32 and the collector of transistor 32 is connected to the control gate of switching transistor 18 of the integral controller 16. A voltage source is coupled to the collector of transistors 30 and 32 through respective load resistors R8 and R10 and through the respective collector-emitter paths to ground. The waveform shown in FIG. 5A represents the potential at the collector of transistor 23 of FIG. 2. The monostable 31 generates a pulse 33 of a duration of $T_1$ in FIG. 5B in response to the leading edge of the output from transistor 23. During the time interval $t_1$ to $t_2$, the transistor 30 is turned on so that its collector potential is at low voltage level which turns off transistor 32. However, the presence of the pulse 33 at the base of transistor 32 biases it into conduction until time $t_1'$, whereby transistor 32 is turned off during time interval $t_1'$ to $t_2$ and during this time interval the collector potential of transistor 32 is at a high voltage level as shown in FIG. 5c. The switching transistor 18 is thus biased into conduction during this time interval. It will be appreciated that if a fuel cut-off operation occurs in a brief period of time shorter than time interval $T_1$, transistor 32 provides no disabling signal so that the disabling circuit 21 is insensitive to a momentary cut-off during transmission gear changes.

Figure 6:
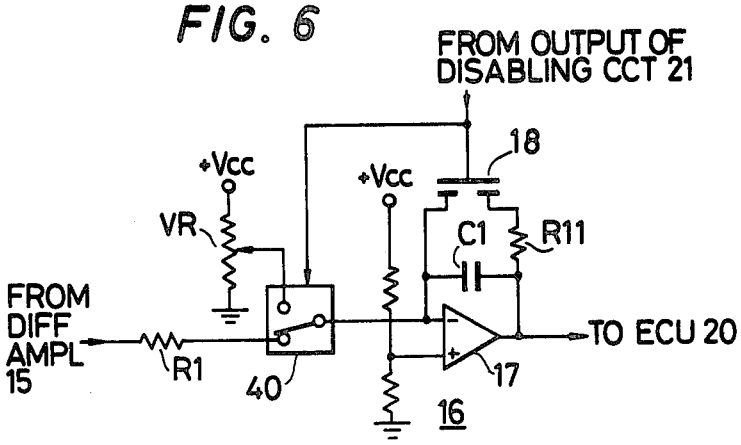
FIG. 6 is a modification of the integral controller of FIG. 1.

In FIG. 6 is shown a modification of the integral controller 16 of the previous embodiment in which a resistor R11 is provided in series with the transistor switch 18 and an electronic switch 40 is provided to normally couple the signal from differential amplifier 15 to the inverting input of operational amplifier 17 and couple a DC potential from the tap point of a variable resistor VR to the inverting input in response to the output from the disabling circuit 21. During the closed loop disabling operation, the output from the integral controller 16 is held at a constant voltage which may be chosen at an appropriate value by adjustment of variable resistor VR so that the air-fuel ratio may be controlled at a correspondingly appropriate value that minimizes the amount of noxious components during the disabling period.

The foregoing description shows only preferred embodiments of the present invention. Various modifications are apparent to those skilled in the art without departing from the scope of the present invention. For example, the present invention can also be applied to an internal combustion engine of the carburetor type involving the use of a fuel cut-off feature. Therefore, the present invention is only limited by the appended claims and the embodiments shown and described are only illustrative, not restrictive.

What is claimed is:

1. In combination with a system for controlling the main air fuel ratio of an internal combustion engine, a circuit for modifying the air fuel ratio supplied by said system to the engine, said circuit being responsive to an exhaust gas sensor, and means responsive to the control system for supplying air and fuel to said engine, wherein the amount of fuel supplied to said engine under the control of the control system is varied in response to various engine operating parameters supplied to the control system and the fuel flow is reduced while the engine is operating in response to particular engine operating parameters supplied to the control system, a system for disabling said modifying circuit while the fuel flow is reduced, said disabling system comprising:

means responsive to the particular parameters for generating an electrical signal having a duration corresponding to the duration of said fuel flow reduction; and means insensitive to said electrical signal when the electric signal has a duration less than a predetermined duration and sensitive to said electrical signal when the electric signal has a duration longer than said predetermined duration for deriving a disabling signal for said circuit, said disabling signal having an interval commencing when said predetermined duration expires and terminating approximately at the end of the duration of said electrical signal.

2. A fuel control system as claimed in claim 1, wherein said disabling signal deriving means includes, means for introducing a delay time in response to the end of the duration of said electrical signal to cause said disabling signal deriving means to prolong said disabling signal to the end of said delay time.

3. A fuel control system as claimed in claim 2, wherein said disabling signal deriving means comprises:

a transistor having a base electrode connected to be responsive to said electrical signal to provide a low resistance path between emitter and collector electrodes;

a comparator having a first input connected to a reference potential; and a series circuit including a resistor and a capacitor connected across the collector and emitter of said transistor, the junction of said resistor and capacitor being connected to a second input of said comparator, whereby said comparator generates a disabling signal having a duration that ranges from a delayed time from the beginning of said electrical signal to a delayed time after the end of said electrical signal.

4. A fuel control system as claimed in claim 1 wherein said disabling signal deriving means comprises means for generating a second electrical signal having a duration equal to said predetermined duration in response to the beginning of the first-mentioned electrical signal, and means for coupling an output signal of the sensor to said main air fuel ratio control system in the absence of said second electrical signal.

5. A fuel control system as claimed in claim 1, wherein said disabling signal deriving means comprises means for generating a waveform having a variable amplitude as a function of time in the presence of said electrical signal, and means for generating an output in response to the waveform reaching a reference level.

6. A fuel control system as claimed in claim 1, wherein said exhaust gas sensor generates a second electrical signal representative of the concentration of an exhaust composition in the gases from said engine, said modifying means comprising: means for generating a third electrical signal representative of the deviation of the second signal from a reference value representing a desired air-fuel ratio, and an integral controller including a capacitor for integrating said third signal, and gate-controlled switching means for providing a low resistance path across said capacitor in response to said disabling signal.

7. A fuel control system as claimed in claim 6, further comprising means for setting a DC potential and second gate-controlled binary switching means providing a first electrical path connecting said second signal to said integral controller when said switching means is in a first binary state in the absence of said disabling signal and providing a second electrical path connecting said DC potential to said integral controller when said switching means is in a second binary state in the presence of said disabling signal.

8. A fuel control system for controlling the ratio of an air fuel mixture supplied to an internal combustion engine, comprising exhaust gas sensor means for deriving a control signal for the air fuel mixture, a fuel controller responsive to the air fuel mixture control signal for controlling the amount of fuel supplied to the engine, said fuel controller being activated to reduce the supply of fuel to the engine in response to an engine parameter indicative of deceleration, said control signal having a first amplitude condition during deceleration to indicate that the mixture has been leaned and having a tendency to activate the controller to enrich the mixture, whereby an excessively rich mixture has a tendency to be supplied by the controller to the engine at the instant fuel is resupplied to the engine, and means for decoupling the control signal from the fuel controller in response to the fuel controller being commanded by the deceleration parameter to reduce the flow of fuel for at least a predetermined interval.

9. A fuel control system as claimed in claim 8 further including means for recoupling the control signal to the fuel controller only in response to the fuel controller being commanded to restore the flow of fuel for a designated interval.

10. A fuel control system as claimed in claim 9 wherein the fuel controller derives bi-level pulses having first and second amplitudes that respectively cause the flow of fuel to the engine to be reduced and restored, the amplitude of the control signal determining the duty cycle of the pulses, said means for coupling and decoupling including means for sensing the average value of the individual pulses, means for smoothing the average value over at least one pulse, and means responsive to the amplitude of the smoothed average value being respectively on first and second sides of a reference value for causing the coupling and decoupling, the smoothing and amplitude being such that the smoothed average value is on the one side of the reference value after the predetermined interval has been completed.

11. A fuel control system as claimed in claim 10 wherein the smoothing differs for the coupling and decoupling.

12. A fuel control system as claimed in claim 10 wherein the smoothing is greater for decoupling than for coupling, whereby the predetermined interval exceeds the designated interval.

13. A fuel control system as claimed in claim 8 wherein the fuel controller derives bi-level pulses having first and second amplitudes that respectively cause the flow of fuel to the engine to be reduced and restored, the amplitude of the control signal determining the duty cycle of the pulses, said means for decoupling including means for sensing the average value of the individual pulses, means for smoothing the average value over at least one pulse, and means responsive to the amplitude of the smoothed average value being on one side of a reference value for causing the decoupling, the smoothing and amplitude being such that the smoothed average value is on the one side of the reference value after the predetermined interval has been completed.

* * * * *